US007121328B1

(12) United States Patent
McDonald et al.

(10) Patent No.: US 7,121,328 B1
(45) Date of Patent: Oct. 17, 2006

(54) CONDENSER

(75) Inventors: Neil Kent McDonald, Georgetown, IN (US); Alexander Pinkus Rafalovich, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/484,292

(22) Filed: Jan. 18, 2000

(51) Int. Cl.
*F28F 13/06* (2006.01)
*F28D 7/04* (2006.01)
*F25B 39/00* (2006.01)

(52) U.S. Cl. ..... 165/125; 165/181; 165/163

(58) Field of Classification Search ..... 165/122, 165/125, 163, 169, DIG. 303, DIG. 306, 165/181, 48.1; 62/508, 507, 509, 428, 454; 29/890.035, 890.037, 890.045, 890.07
See application file for complete search history.

(56) References Cited

U.S. PATENT DOCUMENTS

| | | | | | |
|---|---|---|---|---|---|
| 1,189,470 | A | * | 7/1916 | O'Brien | 165/122 |
| 1,691,180 | A | * | 11/1928 | Carrey | 165/125 |
| 2,311,947 | A | | 2/1943 | Kucher | |
| 2,453,448 | A | * | 11/1948 | McTurk | 165/184 |
| 2,561,278 | A | * | 7/1951 | Hill | 62/279 |
| 2,620,170 | A | * | 12/1952 | Brickman | 165/171 |
| 2,779,173 | A | * | 1/1957 | Wurtz | 62/291 |
| 3,159,213 | A | * | 12/1964 | Wurtz | 165/171 |
| 3,162,023 | A | * | 12/1964 | Smith | 62/455 |
| 3,173,479 | A | * | 3/1965 | Heuer | 165/122 |
| 3,388,562 | A | * | 6/1968 | Harle | 62/507 |
| 3,460,225 | A | * | 8/1969 | Beauvais | 29/890.07 |
| 3,524,329 | A | | 8/1970 | Smith et al. | |
| 3,828,575 | A | | 8/1974 | Mallosky | |
| 3,865,517 | A | * | 2/1975 | Simmons et al. | 417/424.1 |
| 3,907,025 | A | | 9/1975 | Malcosky et al. | |
| 3,908,393 | A | * | 9/1975 | Eubank | 62/305 |
| 3,943,728 | A | | 3/1976 | Maudlin | |
| 4,047,393 | A | * | 9/1977 | Hanson et al. | 62/428 |
| 4,321,803 | A | * | 3/1982 | Smith | 62/507 |
| 4,340,115 | A | * | 7/1982 | Wright et al. | 165/122 |
| 4,723,419 | A | * | 2/1988 | Kessler et al. | 62/507 |
| 5,038,854 | A | | 8/1991 | Peterson, III | |
| 5,097,678 | A | * | 3/1992 | Aubuchon | 62/506 |
| 5,211,219 | A | * | 5/1993 | Kawabata et al. | 165/122 |
| 5,538,075 | A | | 7/1996 | Eubank et al. | |
| 5,592,829 | A | * | 1/1997 | Kim | 62/428 |
| 5,685,166 | A | | 11/1997 | Li | |
| 5,778,973 | A | * | 7/1998 | Shin | 165/122 |
| 5,806,334 | A | | 9/1998 | Shin | |
| 6,435,269 | B1 | * | 8/2002 | Hancock | 165/144 |

* cited by examiner

*Primary Examiner*—Tho Duong
(74) *Attorney, Agent, or Firm*—Armstrong Teasdale LLP

(57) ABSTRACT

A refrigerator condenser includes a spiraled tube and wire member construction to form a substantially longitudinal and rounded passage between a first end and a second end. The second end of the condenser is closed, thereby preventing longitudinal airflow through the passage and producing airflow into the passage in a substantially perpendicular direction to the condenser surface. Heat transfer to the air is thereby maximized and efficiency of the condenser is increased.

20 Claims, 3 Drawing Sheets

CONDENSER

BACKGROUND OF THE INVENTION

This invention relates generally to refrigeration systems and, more particularly, to condensers for refrigerators.

Refrigeration systems typically include a compressor coupled to a condenser so that a compressed refrigerant flows to the condenser. See, for example, U.S. Pat. No. 5,711,159. A condenser fan circulates air over a surface of the condenser to cool the compressed refrigerant and is powered by a condenser fan motor.

Condenser surfaces for refrigerators are typically of tube and wire construction in which a refrigerant tube, or condenser coil, including a plurality of U-shaped segments is attached to a plurality of substantially parallel wires. In one type of condenser, a plurality of tube and wire members are placed in parallel rows underneath a refrigerator cabinet in an air flow path extending from a front of the refrigerator cabinet. See, for example, U.S. Pat. No. 5,592,829 However, this requires an increased distance between the refrigerator cabinet and a floor to provide adequate air access to the condenser surfaces, and, more importantly, suffers from reduced efficiency due to unevenly distributed airflow across the condenser surfaces and airflow parallel to the refrigerant tubes and/or wires. Air flowing through a relatively small air path through a lower front of the refrigerator produces relatively high air velocity and pressure drop of the air, which reduces an airflow rate across the condenser, increases noise, and reduces condenser efficiency. The reduced condenser efficiency results either in a decreased energy efficiency of the refrigerator or an increased cost in the condenser because of extra coil that is required to obtain a required heat transfer to the air.

Rectangular or cube shaped condensers have been developed to reduce the condenser volume and conserve space. See, for example. U.S. Pat. No. 5,685,166. However, these condensers also suffer efficiency losses due to uneven airflow over the condenser surfaces and airflow parallel to the condenser surfaces. Thus, extra coil is often required to achieve a desired heat transfer to the air. Also, a considerable number of U-shaped elbows with small radiuses are required to fabricate the rectangular condenser shape, which increases condenser cost and decreases condenser reliability.

Accordingly, it would be desirable to provide a refrigerator condenser that more effectively transfers heat to the air, promotes even air flow across the condenser surface, reduces the need for extra condenser coil, and avoids the need for U-shaped elbows of small radius that compromise condenser reliability and increases condenser cost.

BRIEF SUMMARY OF THE INVENTION

In an exemplary embodiment of the invention, a refrigerator condenser includes a longitudinal axis and a tube and wire member spiraled about the longitudinal axis. A passage extends through the tube and wire member between a first end and a second end. The second end is closed to prevent longitudinal air flow through the second end. Thus, when used with a condenser fan mounted in the first end, air is drawn into the passage substantially perpendicularly to an outside surface of the condenser and through the spiraled tube and wire member. The perpendicular airflow through the condenser surface maximizes heat transfer to the air, increases the efficiency of the condenser, and reduces the need for extra coil to achieve a selected heat transfer to the air. Moreover, the spiraled tube and wire member produces a compact condenser while avoiding the use of small radius elbows that increase the cost of the condenser and reduce condenser reliability.

DETAILED DESCRIPTION OF THE INVENTION

Figure 1:
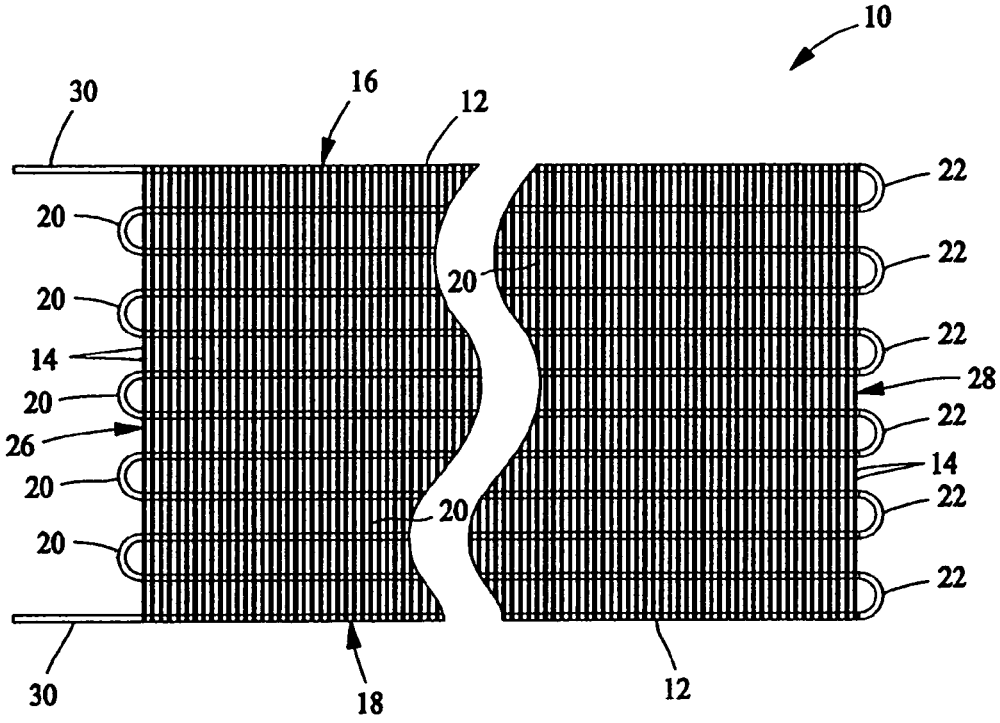
PRIOR ART FIG. 1
FIG. 1 is a partial plan view of a known condenser tube and wire member.

FIG. 1 is a partial top plan view of a known condenser tube and wire member 10 fabricated from known methods and materials. Tube and wire member 10 includes an extended refrigerant tube 12, or condenser coil, attached to a plurality of substantially parallel wires 14 extending from a first end 16 to a second end 18. Tube 12 includes a plurality of U-shaped segments 20 extending substantially perpendicularly to wires 14 and joined to one another. The number of U-shaped segments 20 is selected to achieve a desired heat transfer rate to air flowing over a surface 20 of tube and wire member 10 without excessive pressure drop in refrigerant flowing inside refrigerant tube 12. Tube and wire member 10 is substantially flat and rectangular, and includes an outer edge 26 and an inner edge 28 at a bend of each U-shaped segment 20 of tube 12. Tube connector segments 30 extend from outer edge 26 for connection to a refrigerator circuit (not shown). It is recognized that other known configurations of tube and wire members could be used in alternative embodiments within the scope of the present invention.

Figure 2:
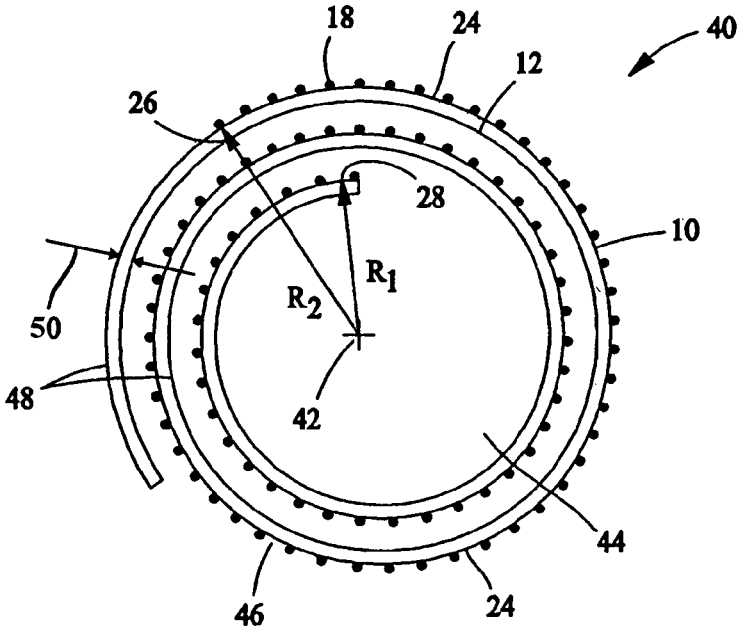
FIG. 2 is an end view of the condenser tube and wire member formed into a condenser.

FIG. 2 is an end view of tube and wire member 10 formed into a condenser 40. Outer edge 26 is wrapped around inner edge 28 to form an extended rounded shape about a longitudinal axis 42 that is substantially parallel to inner edge 28 and outer edge 26. An asymmetrically rounded opening 44 is formed between first end (not shown) and second end 18 and is substantially constant in cross sectional area between the first end and second end 18 of condenser 40. Inner edge 28 is positioned a first radial distance R1 from longitudinal axis, and outer edge 26 is positioned a second radial distance R2 from longitudinal axis 42 that is greater than R1. Tube and wire member second end 18 forms a spiraled edge 46 including a number of wraps 48 of tube and wire member 10. Each complete revolution, i.e., 360 degrees about longitudinal axis 42, of refrigerant tube 12 form inner edge 28 constitutes one wrap 48. In other words, a new wrap 48 begins when spiraled refrigerant tube 12 passes tube and wire member inner edge 28 and begins to overlap a portion of refrigerant tube 12 underneath. Thus, a layered condenser surface 24 is obtained. While FIG. 2 illustrates about two whole wraps 48 of refrigerant tube 12, other numbers of wraps, including partial wraps, could be used in alternative embodiments, such as three, four, or even more. Refrigerant tube 12 has an outer diameter 50.

In one embodiment, wraps 48 are layered about longitudinal axis 42 in an Archimedes spiral defined by the relationship $$R=A\theta$$

where A is a selected constant, θ is an angular distance from a beginning, or center, of the spiral, and R is a radial distance to a point in the spiral from the center of the spiral. Therefore, R constantly increases along each wrap 48, and a distance between adjacent wraps 48 is approximately equal from one wrap to the next. In a further embodiment, each wrap includes segments of an Archimedes spiral having different center points to facilitate manufacturing of spiraled tube and wire member 10. Other types of spirals, with or without multiple centers for the wraps, and with or without substantially uniform distance between the wraps, are employed in various alternative embodiments without departing from the scope of the invention.

Figure 3:
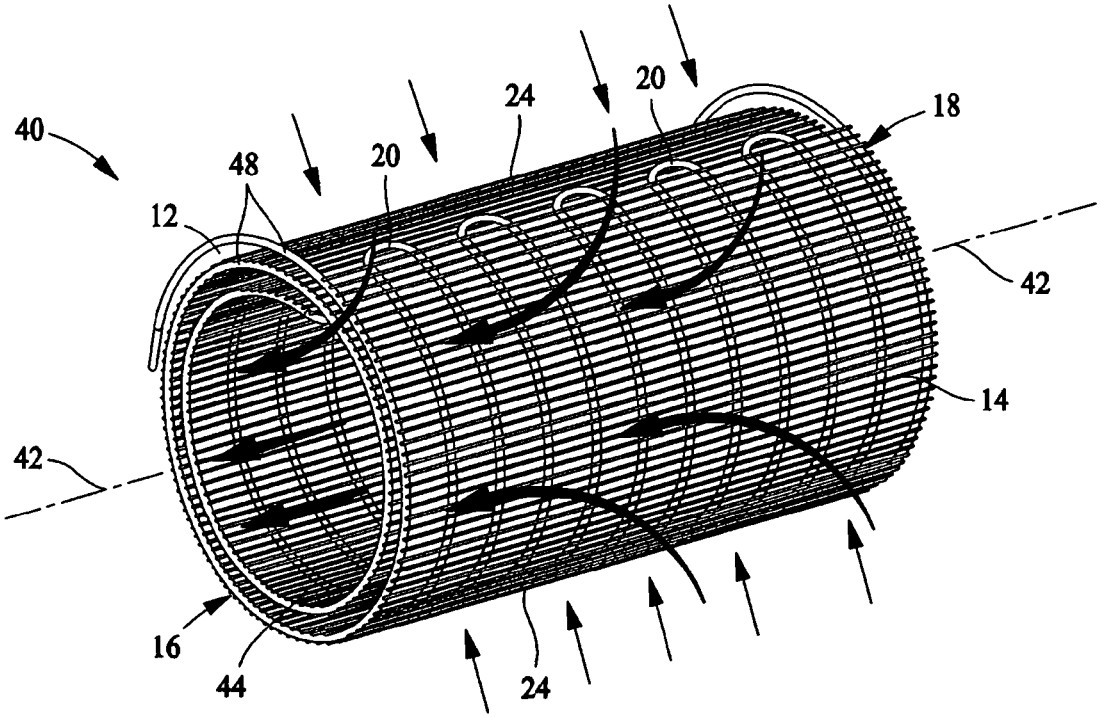
FIG. 3 is a perspective view of the condenser shown in FIG. 2.

FIG. 3 is a perspective view of condenser 40 including rounded opening 44 about longitudinal axis 42 and illustrating air flow therethrough with arrows. Second end 18 of condenser 40 is closed to prevent air from flowing longitudinally through condenser opening second end 18. A fan blade (not shown) is mounted at condenser opening first end 16 and driven by a motor (not shown) to draw air through condenser surface 24 and transfer heat from condenser surface 24 to the air. Because second end 18 is closed, air is drawn into condenser 40 substantially perpendicular to condenser surface 24, i.e., substantially perpendicular to both refrigerant tube 12 wires 14, of each wrap 48 to maximize heat transfer from condenser surface 24 to the air and increase the efficiency of condenser 40. After flowing substantially perpendicularly past refrigerant tubes 12 and wires 14, air converges inside opening 44 and is exhausted by the fan blade at first end 16 through opening 44 substantially perpendicular to longitudinal axis 42.

Figure 4:
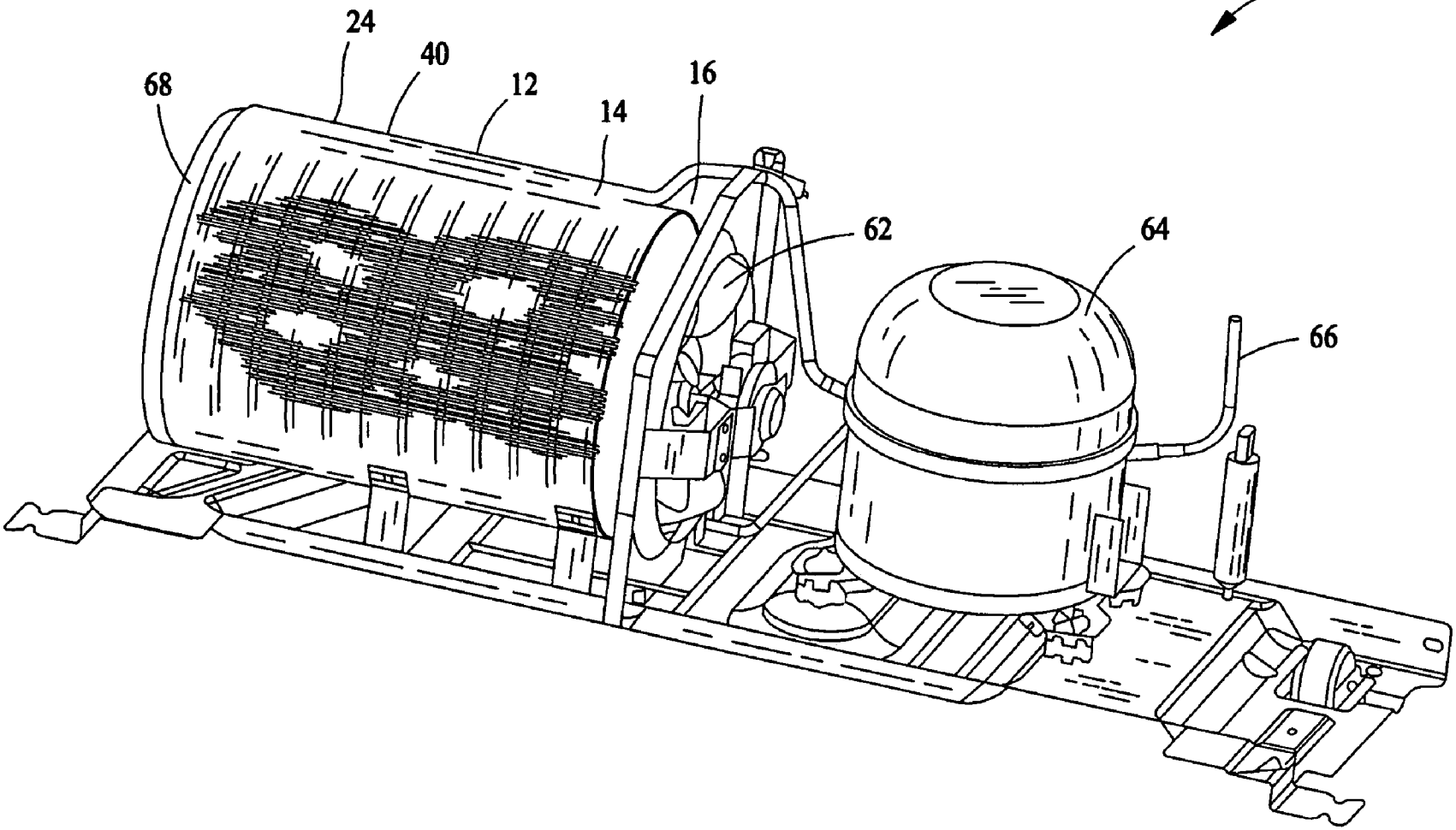
FIG. 4 is a perspective view of a refrigerator condenser assembly.

FIG. 4 is a perspective view of a refrigerator condenser assembly 60, including condenser 40, fan blade 62 and compressor 64. Compressor 64 compresses refrigerant supplied by an evaporator (not shown) through a suction line 66. Compressor 64 adds work to the refrigerant, which heats the refrigerant before flowing into condenser 40. High pressure and high temperature gaseous refrigerant leaves compressor 64 through a discharge port and flows to condenser 40, where high pressure gaseous refrigerant is cooled to a saturation temperature, eventually condensing the refrigerant into a liquid state.

A baffle 68 is mounted at condenser second end 18 to prevent longitudinal air flow parallel to wires 14 that decreases heat transfer efficiency. Fan blade 62 is mounted at condenser first end 16 external of opening 44 and draws air through condenser 40 substantially perpendicular to condenser outer surface 24 and longitudinally after condenser 40 and toward compressor 64 to cool compressor 64 as well. In alternative embodiments, other closure members besides baffle 68 are used to close condenser second end.

Thus, a compact, energy efficient and inexpensive condenser 40 is provided. Condenser 40 is easily fabricated by bending flat tube and wire member 10 (shown in FIG. 1) into a spiral shape about longitudinal axis 42, and because air flow is directed substantially perpendicularly and evenly through condenser surface 24, condenser outperforms condensers of the prior art and reduces the need for extra coil to achieve a desired heat transfer to the air. Furthermore, the compactness is achieved without the use of small radius elbows connecting evaporator tube segments that tend to increase condenser cost and decrease condenser reliability.

While the invention has been described in terms of various specific embodiments, those skilled in the art will recognize that the invention can be practiced with modification within the spirit and scope of the claims.

What is claimed is:

1. A method for increasing the efficiency of a refrigerator condenser assembly including a tube and wire member having an inner edge and an outer edge, said method comprising the steps of:

forming the tube and wire member into a spiral including first and second ends and a longitudinal passageway therebetween, said tube and wire member including a tube having an outer diameter and a substantially circular cross section;

closing the first end, thereby preventing longitudinal air flow through the first end; and drawing air flow into the longitudinal passageway in a direction substantially perpendicular to the tube and wire member.

2. A method in accordance with claim 1 wherein said step of forming the tube and wire member into a spiral comprises the step of bending a flat tube and wire member into a spiral.

3. A method in accordance with claim 2 wherein the tube and wire member includes a plurality of U-shaped segments attached to a plurality of parallel wires, said step of bending the tube and wire member comprises the step of bending the plurality of U-shaped tube segments about an axis parallel to the wires.

4. A method in accordance with claim 1 wherein said step of forming the tube and wire member into a spiral comprises the step of forming a spiral with fewer than about five wraps.

5. A method in accordance with claim 1 wherein said step of closing the first end comprises the step of mounting a baffle over the first end of the tube and wire member.

6. A method in accordance with claim 1 further comprising the step of mounting a rotatable fan blade assembly at the second end of the longitudinal passageway, the fan blade assembly drawing air into the longitudinal passageway substantially perpendicularly to an outer surface of the tube and wire member.

7. An apparatus comprising a refrigerator condenser comprising a spiraled tube and wire member defining a longitudinal passage and a closed end, said spiraled tube and wire member including a tube having an outer diameter and a substantially circular cross section, said closed end preventing longitudinal air flow therethrough such that the air flow is drawn substantially perpendicular to said tube and wire member.

8. An apparatus in accordance with claim 7 wherein said spiraled tube and wire member comprises a plurality of U-shaped segments.

9. An apparatus in accordance with claim 7 wherein said spiraled tube and wire member comprises:

a longitudinal axis extending along said passage;

a first end;

a second end; and said passage extending through said tube and wire member between said first end and said second end, one of said first and second ends defining said closed end.

10. An apparatus in accordance with claim 9 wherein said passage is asymmetrically rounded.

11. An apparatus in accordance with claim 7 wherein said tube and wire member comprises an inner edge, an outer edge, and a longitudinal axis, said inner edge and said outer edge substantially parallel to said longitudinal axis, said inner edge a first radial distance from said longitudinal axis, said outer edge a second radial distance from said longitudinal axis, said second radial distance larger than said first radial distance.

12. An apparatus in accordance with claim 11 wherein said tube and wire member further comprises a spiraled edge comprising at least one wrap of said wire and tube member.

13. An apparatus in accordance with claim 12 wherein said spiraled edge comprises between one to about four wraps of said tube and wire member.

14. A refrigerator condenser assembly comprising:

a spiraled tube and wire member comprising a first end, a second end, and a passage therebetween, said spiraled tube and wire member including a tube having an outer diameter and a substantially circular cross section;

a fan blade assembly mounted at said second end and external to said passage; and a closure member mounted at said first end, said closure member preventing air from entering said passage through said first end, and said closure member configured to facilitate drawing air into said passage in a substantially perpendicular direction with respect to said spiraled tube and wire member.

15. A refrigerator condenser assembly in accordance with claim 14 wherein said closure member comprises a baffle.

16. A refrigerator condenser assembly in accordance with claim 14 wherein said tube and wire member further comprises a plurality of U-shaped segments.

17. A refrigerator condenser assembly in accordance with claim 14 wherein said passage is asymmetrically rounded.

18. A refrigerator condenser assembly in accordance with claim 14 wherein said tube and wire member further comprises an inner edge, an outer edge, and a longitudinal axis, said inner edge and said outer edge substantially parallel to said longitudinal axis, said inner edge a first radial distance from said longitudinal axis, said outer edge a second radial distance from said longitudinal axis, said second radial distance larger than said first radial distance.

19. A refrigerator condenser assembly in accordance with claim 18 wherein said tube and wire member further comprises a spiraled edge comprising at least one wrap of said wire and tube member.

20. A refrigerator condenser assembly in accordance with claim 19 wherein said spiraled edge comprises between about one to about four wraps of said tube and wire member.

* * * * *